United States Patent [19]

Malcolm

[11] 3,952,940

[45] Apr. 27, 1976

[54] PAPERBOARD CARTONS WITH LIQUID-PROOF LINERS

[75] Inventor: James A. Malcolm, Downsview, Canada

[73] Assignee: Flag Carton Corporation Ltd., Downsview, Canada

[22] Filed: Feb. 24, 1975

[21] Appl. No.: 552,567

Related U.S. Application Data

[62] Division of Ser. No. 265,964, June 26, 1972, Pat. No. 3,878,771.

[52] U.S. Cl. ..... 229/14 BA; 229/17 R; 229/51 D; 229/52 B

[51] Int. Cl.[2] ..... B65D 5/40; B65D 5/70

[58] Field of Search ..... 229/14 BA, 14 BE, 14 BL, 229/17 R, 52 B, 51 D, 7 R, 17 G; 206/815

[56] References Cited

UNITED STATES PATENTS

| | | | |
|---|---|---|---|
| 2,337,730 | 12/1943 | Berch | 229/14 BE |
| 2,434,756 | 1/1948 | Brooks | 229/17 R |
| 2,933,229 | 4/1960 | Bensel | 229/14 BE |
| 3,387,764 | 6/1968 | Forrest | 229/14 BA |
| 3,426,955 | 2/1969 | Olson | 229/14 BA |
| 3,459,357 | 8/1969 | Egger et al. | 229/14 BA |
| 3,464,619 | 9/1969 | Nordstrom | 229/52 B |
| 3,550,833 | 12/1970 | Rahenkamp | 229/14 BA |
| 3,807,624 | 4/1974 | Funkhouser | 229/52 B |

FOREIGN PATENTS OR APPLICATIONS

| | | | |
|---|---|---|---|
| 875,658 | 8/1961 | United Kingdom | 229/14 BA |

*Primary Examiner*—William Price
*Assistant Examiner*—Bruce H. Bernstein

[57] ABSTRACT

A container for liquids such as milk comprises an outer paperboard carton and an inner tubular liner of flexible plastic film adhered to the carton, the liner being adhered to the walls of the carton adjacent diagonally opposite corners of one end of the carton. The sidewalls of the carton adjacent one of these corners are formed with a line of weakness, the liner being adhered to the carton on either side of this line so that the corner may be lifted from the remainder of the carton to split both the carton and the liner and allow the contents of the container to be discharged from a pouring lip thus formed at the corner of the container.

13 Claims, 2 Drawing Figures

PAPERBOARD CARTONS WITH LIQUID-PROOF LINERS

CROSS REFERENCE TO RELATED APPLICATIONS

This application is divided out of my copending application No. 265,964, filed June 26, 1972, now U.S. Pat. No. 3,878,771.

FIELD OF THE INVENTION

This invention relates to containers of the type comprising a liquid proof flexible liner supported within an outer paperboard carton, and more particularly a container suitable for dispensing such liquids as milk by pouring from a lip formed directly on the container.

DESCRIPTION OF THE PRIOR ART

It has heretofore been proposed to provide containers of the above type for holding liquids and other fluid materials, but various difficulties have been encountered in producing a structure which is readily set up and filled, and easily opened and emptied, the problems of opening varying according to the manner in which the contents of the containers are to be dispensed.

SUMMARY OF THE INVENTION

In accordance with the present invention a container for liquid such as milk comprises an outer paperboard carton and an inner tubular liner of flexible plastic film adhered to the carton adjacent diagonally opposite corners of one end of the carton. The sidewalls of the carton adjacent one of these corners are formed with a line of weakness, the liner being adhered to the carton on either side of this line. On lifting this corner away from the rest of the carton, both the carton and the liner are split, leaving a pouring lip at the corner of the container.

The end of the carton is formed by overlying flaps extending from the side panels of the carton and those portions of the flaps which overlie the corner of the carton which is lifted to open the container are themselves weakened or cut away to facilitate opening. The inner liner is sealed along a line extending across the other diagonal of the end of the container which is intended to be opened.

BRIEF DESCRIPTION OF THE DRAWING:

A preferred embodiment of container according to the invention is described with reference to the accompanying drawing, in which.

DESCRIPTION OF THE PREFERRED EMBODIMENT

Figure 1:
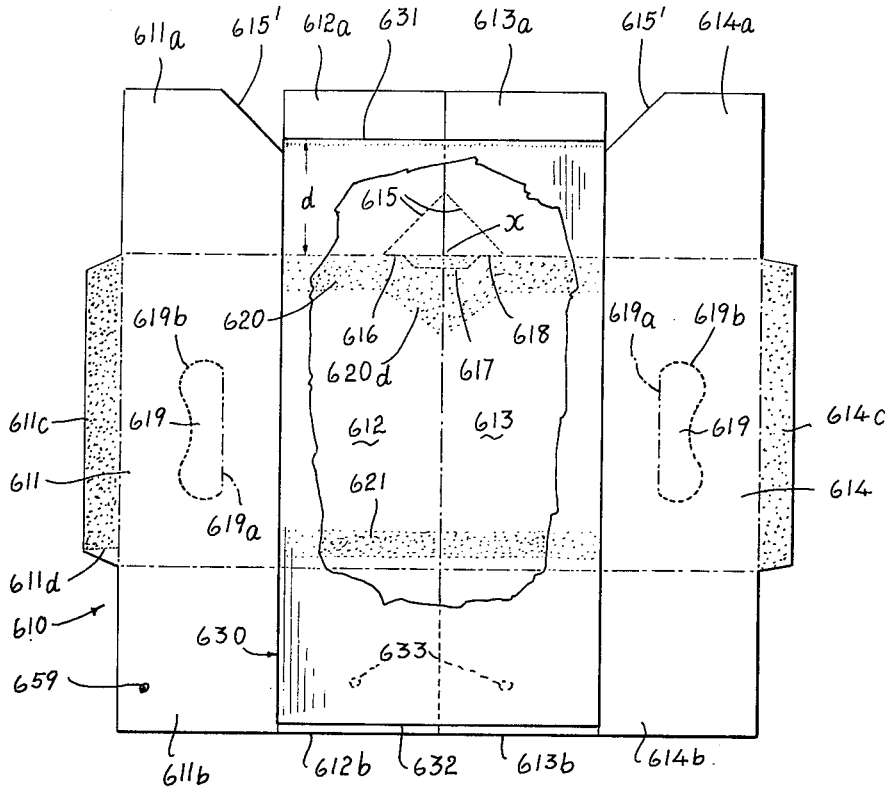
FIG. 1 shows a carton blank with a tubular bag positioned thereon (part of the bag being cut away)
Figure 2:
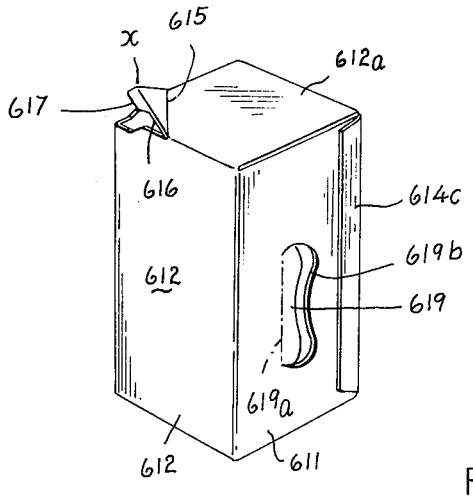
FIG. 2 shows a container formed from the blank and bag of FIG. 1.

Referring to the drawings, a carbon blank 610 consists of rectangular panels 611, 612, 613, 614 having flaps 611*a*, 612*a*, 613*a*, 614*a* at one end and flaps 611*b*, 612*b*, 613*b*, 614*b* at the other. A line of adhesive 620 is applied on the panels 612, 613 along the crease line separating these panels from their flaps 612*a*, 613*a*, the line 620 being extended downwardly as at 620*d* at the juncture of the panels 612 and 613. Another adhesive line 621 crosses panels 612 and 613 near their other end. Spots of adhesive 633 are applied to flaps 612*b*, 613*b*, and a bag 630 is formed and laid over the central panels 612, 613 and parts of their end flaps, for example by the apparatus of FIG. 1 of my copending patent application Ser. No. 265,964, filed June 26, 1972, for 'Manufacture of Paperboard Cartons with Liquid-proof Liners', the disclosure of which is hereby included herein by reference. The bag has a sealed end 631 and an open end 632. The sealed end 631 is located the distance "*d*" from point "*x*" at the juncture of panels 612, 613. Both panels 611 and 614 are provided with edge flaps 611*c* and 614*c* respectively. When the carton is to be set up, the side of flap 614*c* seen in FIG. 1 is covered with adhesive, a spot of adhesive 659 is applied to end flap 611*b*, and both sides of edge flap 611*c* are coated with adhesive, but the adhesive on the side of flap 611*c* seen in FIG. 1 terminates at 611*d* level with the lower edge of adhesive line 621. Panel 611 is folded over panel 612 so that flap 611*c* and spot 659 adhere to the bag 630, and then panel 614 is folded over panel 613 to adhere to flap 611*c*, and flap 614*c* also adheres to panel 611 and overlies it as seen in FIG. 2 which shows the erected container. The end flaps 611*a*, 613*a*, 614*a*, and 612*a* are folded down and glued together in that order, the bag 630 is filled from its open end 632, and then the bag is pulled away from the spots 633, 659 and closed, and the end flaps 611*b*, 612*b*, 613*b*, 614*b* are closed and glued together.

In the set-up container the bag is taut along a diagonal of the upper end of the container extending from the corner "*x*" to the upper end of the flap 611*c*, the adhesive at the ends of this diagonal being spaced from the bag seal 631 by the distance "*d*". The line of adhesive 620 secures the bag to the carton along the upper edges of the panels 612 and 613, and adjacent corner "*x*" these panels are weakened by a perforated line that extends at 616 for a short distance along the crease between panel 612 and flap 612*a*, then deviates downwardly as at 617 to form a tab portion at the juncture of panels 612, 613, and then extends at 618 for a short distance along the crease between panel 613 and flap 613*a*. From the outer ends of perforated lines 616 and 618 two crease lines 615 define triangular corner portions of the end flaps 612*a*, 613*a*, corresponding in size to triangular corner portions that are removed from end flaps 611*a* and 614*a* along lines 615'. When the container is set up, the lines 615, 615' coincide and form a fulcrum about which the corner of the container can be opened by pushing in the tab portion above line 617 and lifting the tab portion and the triangular corner portions of flaps 612*a*, 613*a*. It is to be noted that the bag is adhered to the carton both above and below the line 617, and when the tab portion is pushed in and lifted the part of the bag attached to it tears along the lines 616, 617, 618, so that the contents of the container can be poured over the lip formed at the juncture of panels 612 and 613. The additional adhesive area 620*d* is provided to ensure that the bag remains affixed to the carbon below the pouring lip, to prevent bleeding or leakage of the contents of the bag and consequent weakening of the paperboard. To facilitate grasping the container for pouring, flaps 619 can be pressed inwardly in the panels 611 and 614 about crease lines 619*a*, the flaps 619 being defined by these crease lines and by perforated lines 619*b*. The carton can be gripped in one hand by pressing one flap 619 inwardly with the fingers and the other flap 619 with the thumb, the flaps guarding the bag against puncture by the fingernails. The edge flaps 611*c* and 614*c* reinforce the carton along the edge where it is gripped, opposite the corner "*x*".

Modifications of the preferred embodiment herein described will readily occur to those skilled in the art, and are intended to be covered by the subjoined claims.

What I claim as my invention is:

1. A knocked down container that can be erected into a rectangular box that has a liner and is suitable for holding and dispensing fluid material, comprising a paperboard blank having four rectangular side forming panels, flaps protruding beyond the ends of the panels for closing the ends of the box, a flexible tubular liner arranged flat on the inner surfaces of a pair of adjoining panels and coterminous with the total width of said pair of panels, the liner protruding longitudinally beyond the ends of said pair of panels, a seal closing one end of the liner, the other end of the liner being unsealed, said seal extending widthwise of the liner whereby when the box is erected, said seal extends adjacent one diagonal of one end of the box, areas on the blank being adhesively attached to the liner at locations adjacent the ends of the other diagonal of said box end, the adhesive at said locations being longitudinally spaced from said seal by a distance half the length of said other diagonal whereby when the box is erected the liner will be taut adjacent said other diagonal, and wherein the blank is weakened along a line extending into two adjacent side forming panels and across one of said areas, providing when the box is erected a corner of the box adhered to the liner which corner can be lifted to tear the box and liner simultaneously along the weakened line and leave a pouring lip on the container.

2. A container as claimed in claim 1 wherein the adhesive treated areas include a band of adhesive along the ends of said pair of panels closest to said seal.

3. A container as claimed in claim 1, wherein said pair of panels are the central panels of the blank, and the other two panels can be joined by a flap at the edge of one of them, wherein the adhesive treated areas comprise a first band of adhesive extending widthwise of said pair of central panels near one end thereof at said distance from said seal, and a second band of adhesive on the last mentioned flap, wherein a third band of adhesive extends widthwise of said pair of central panels near the opposite end thereof, and wherein the other end of the liner is open for filling the liner when the box is erected.

4. A container as claimed in claim 3 wherein the end flaps of the blank are adhesively secured to the liner adjacent its unsealed end to assist in manipulating the liner during setting up and closing of the container.

5. A container comprising an outer folded paperboard carton having flat rectangular ends, an inner flexible bag containing fluid material, the bag substantially filling the carton and being affixed thereto and supported thereby, wherein the bag is adhesively affixed to areas of the interior of the carton adjacent the ends of one diagonal of one end of the carton and is taut adjacent said diagonal, wherein two adjacent sidewalls of the carton have a line of weakness extending across one of said areas around a corner of the carton adjacent one end of said diagonal so that an area in which the bag is adhered to the carton extends across said line, whereby by lifting said corner of the carton the container can be opened along said line of weakness and the bag will simultaneously tear therealong.

6. A container as claimed in claim 5, wherein said one end of the carton is formed by flaps extending from the sidewalls of the carton, portions of the flaps extending from said two adjacent sidewalls of the carton and adjacent said line of weakness also being provided with lines of weakness about which said portions may bend to provide a fulcrum for the lifting of said corner, and wherein the overlying portions of the remaining flaps are cut away.

7. A container according to claim 5 wherein the bag is a tubular bag closed by a seal that is transverse to the bag and extends along the other diagonal of said one end of the carton.

8. A container as claimed in claim 5, wherein the bag is fixed to the carton along a band of adhesive extending along the inner surface of said two adjacent sidewalls of the carton and surrounding said line of weakness.

9. A container as claimed in claim 8, wherein the bag is further affixed to the carton along a band of adhesive extending longitudinally of the carton from the other end of said first diagonal, the bands of adhesive being, at the ends of the first diagonal, spaced from said seal by a distance half the length of said first diagonal whereby tautness of the bag is achieved.

10. A container as claimed in claim 9, wherein the downwardly extending band of adhesive is provided on an inturned flap joining two sides of the carton.

11. A container as claimed in claim 9, wherein the bag is further affixed to the carton along a band of adhesive extending near the other end of the carton along the inner surfaces of said two adjacent sides of the carton.

12. A container as claimed in claim 5, wherein the carton has in adjacent sidewalls thereof a pair of side flaps that can be pressed inwardly to grasp the container, the side flaps being spaced from locations where the bag is affixed to the carton whereby the bag can flex when the side flaps are pressed inwardly.

13. A container as claimed in claim 12, wherein the adjacent sidewalls are joined by at least one glued flange projecting from one of the adjacent sidewalls and overlapping the other adjacent sidewall.

* * * * *